US006406107B1

(12) United States Patent
Franczak

(10) Patent No.: US 6,406,107 B1
(45) Date of Patent: Jun. 18, 2002

(54) GRAVITY FEED MULTIPLE SIZED AND SHAPED PACKAGE DISPLAY DISPENSER

(75) Inventor: Richard M. Franczak, Old Bridge Township, NJ (US)

(73) Assignee: Taurus Display Inc., Cherry Hill, NJ (US)

( * ) Notice: Subject to any disclaimer, the term of this patent is extended or adjusted under 35 U.S.C. 154(b) by 0 days.

(21) Appl. No.: 09/754,946

(22) Filed: Jan. 4, 2001

(51) Int. Cl.[7] ..... A47F 3/02

(52) U.S. Cl. ..... 312/42; 312/234; 211/49.1; 211/59.2

(58) Field of Search ..... 312/42, 45, 50, 312/60, 72, 73, 234, 234.1; 211/42, 45, 49.1, 59.2; 221/133, 281, 282

(56) References Cited

U.S. PATENT DOCUMENTS

| | | | | |
|---|---|---|---|---|
| 849,590 A | * | 4/1907 | Bailey | 312/42 |
| 1,676,356 A | | 7/1928 | Sapinsley | |
| 2,340,561 A | | 2/1944 | Renfro | |
| 3,433,545 A | | 3/1969 | Rainey | 312/42 |
| 4,037,756 A | | 7/1977 | Jaquish | 312/42 X |
| 4,305,628 A | | 12/1981 | Glasener | 312/42 |
| 4,597,614 A | | 7/1986 | Alexander | 312/42 |
| 4,769,573 A | | 9/1988 | Celik | 312/60 |
| 4,779,745 A | | 10/1988 | Prendergast et al. | 211/59.2 |
| 5,515,999 A | | 5/1996 | Jo | 312/42 X |
| 5,839,585 A | | 11/1998 | Miller | 211/49.1 |

FOREIGN PATENT DOCUMENTS

| | | | | |
|---|---|---|---|---|
| DE | 805066 | * | 5/1951 | 312/42 |

* cited by examiner

*Primary Examiner*—James O. Hansen
(74) *Attorney, Agent, or Firm*—Thomas A. Lennox, Esq.

(57) ABSTRACT

A point of purchase gravity feed packaged product dispenser with replaceable graphic advertising display panels on the front and sides includes a housing holding packaged products stacked vertically with a bottom front dispensing opening, guide members that pivot inwardly at adjustable chosen angles from the rear and side walls to guide and adjust to the size of the product package, and guide members that pivot upwardly at adjustable chosen angles from the floor to guide and adjust the height of the dispensing opening. The housing of the dispenser is a parallelepiped molded of a polyolefin in two parts, one part the side walls, a back wall and a bottom wall connected by living hinges and interlocking to a front wall forming opposing grooves along each front vertical edge to receive graphic panels.

16 Claims, 7 Drawing Sheets

GRAVITY FEED MULTIPLE SIZED AND SHAPED PACKAGE DISPLAY DISPENSER

FIELD OF THE INVENTION

This invention is directed to point of purchase display and product dispensers. More particularly, an embodiment of this invention involves display dispensers that are adjustable to dispense a variety of shapes and sizes of packaged products.

BACKGROUND OF THE INVENTION

Point of purchase displays and dispensing devices are an important segment of retail marketing. Free standing dispensers coupled with advertising graphic messages are common sights close to the cashier and scattered throughout most retail stores. These dispensers take a variety of forms and some depend upon a gravity feed to supply a fresh package to replace the packages removed by the consumer or the store clerk. Products that are dispensed in this manner include cigarette packages, audio and video cassette packages, camera film, women's hosiery, as well as a myriad of other consumer products. It is certainly possible to design a free standing gravity feed dispensing container for a given sized and shaped package. However, a gravity feed dispenser capable of adjustment to dispense a variety of sized and shaped packages is not available.

Prior art devices are described below and include U.S. Pat. No. 3,433,545 to Rainey discloses a typical display and vending apparatus with circa 1960's type internal chutes and guides as shown in FIGS. 2 & 14. This device does not teach or make obvious either the vertical or horizontal hinged guides or the locking tabs with the grooves to receive graphic displays.

U.S. Pat. No. 4,779,745 to Prendergast et al. discloses a display and dispensing apparatus with the side and rear walls molded in one piece joined by vertical living corner hinges. Dividers 42, 52, and 62 are rigid and not adjustable. The walls are held in position by sleeve 20. This device does not teach or make obvious either the vertical or horizontal hinged guides or the locking tabs with the grooves, although a sleeve does provide graphic display.

U.S. Pat. No. 4,305,628 to Glasener discloses a pilferproof dispensing apparatus with a non-adjustable ramp and guides, the packages being dispensed from the rear by insertion of a finger by the clerk. Vertical grooves 27 and 28 are provided to receive graphic advertising panels on the front to the device. This device does not teach or make obvious either the vertical or horizontal hinged guides. The patent does teach grooves to receive graphic displays, but they are not in conjunction with and formed by the locking tabs of the present invention.

U.S. Pat. No. 4,037,756 to Jaquish discloses a display and dispensing apparatus capable of dispensing various sized and shaped packages using rear spacer 40 that spring clips into positioned slots, and is equipped with knee 42 to aid in dispensing the packages. The dispensing opening is adjustable using plate 30 sliding up and down in channels 26 as shown in FIGS. 3 to 5. This device does not teach or make obvious either the vertical or horizontal hinged guides or the locking tabs of the present invention.

U.S. Pat. No. 5,515,999 to Jo discloses an open topped audio cassette displayer and dispensing apparatus that non adjustable, but does include transparent sleeves for display of graphic sheets/cards. This device does not teach or make obvious either the vertical or horizontal hinged guides or the locking tabs of the present invention.

U.S. Pat. No. 4,769,573 to Celik discloses a tape cassette gravity fed dispenser molded of plastic. The walls are rigid. This device does not teach or make obvious either the vertical or horizontal hinged guides or the locking tabs of the present invention.

None of these devices disclose a device that satisfies the needs described above and below nor attains the objects of the invention described herein below.

SUMMARY OF INVENTION

As pointed out above, a variety of point of purchase dispensers are available with graphic displays to alert the consumer that the product is very conveniently available. How ever, a serious problem arises when a change is necessary for the size and/or the shape of the package. The new product packages may not fit into the prior gravity feed dispenser, or they may hang up inside the prior dispenser and block the supply of the packages from the consumer. For example, video cartridges are not only of the VHS size and shape, but also the DVD size and shape. To further complicate the matter, the VHS cartridges are packaged in a variety of containers, including a slip sleeve, clam shell, and capsule containers, and probably others to come. A dispenser for one of these packages may well not perform with different sized package. Many other consumer products, including cigarettes, are marketed in wide variety of package sizes and shapes. It is most desirable to be able to adjust the dispenser to handle without fail a newly sized package. As in a preferred embodiment, it is also most desirable to replace a part of the graphic display without having to change the entire display.

It is an object for an embodiment of the present invention to provide a point of purchase gravity feed dispenser that is adjustable to feed and dispense a variety of sized and shaped packages.

It is an additional object for an embodiment of the present invention to provide a point of purchase gravity feed dispenser for which the height, width and length of the package to be dispensed can be adjusted individually to varying degrees and in any combination.

It is an additional object for a preferred embodiment of the present invention to provide a point of purchase gravity feed dispenser that is injection molded out of a pliable plastic, preferably a polyolefin polymer, in one, two or three parts with each side panel and the front panel adapted to receive graphic panels slid into opposing grooves and tabs to cover the respective panel.

It is an additional object for a more preferred embodiment of the present invention to provide a parallelepiped box shaped point of purchase gravity feed dispenser that is injection molded out of a polyolefin plastic in two parts, one part with opposing vertical side panels, a back panel and a bottom panel joined at their adjacent adjoining edges by living hinges, and a second part being a front panel adapted to interlock to the free vertical edges of the side panels forming opposing vertical grooves or tabs along each vertical edge adapted to receive graphic panels slid into the opposing grooves or tabs to cover the front panel.

An embodiment of the invention is a gravity feed packaged product dispenser including a housing with an inner chamber of sufficient size and shape to hold a plurality of packaged products stacked vertically. The housing includes a bottom wall with an inside floor surface, a rear wall with an inside surface, a right side wall with an inside surface, a left side wall with an inside surface, and a front wall with a lower edge. The housing has a front opening extending frontwardly from the inner chamber having a height bounded by the lower edge of the front wall and the inside floor surface. The dispenser also includes at least one side guide device including at least one side guide member capable of extending inwardly into the inner chamber from the inside surface of a side wall, the member including an outer edge connected to the inside surface of the side wall by a vertical living hinge, and an elongate vertical inner edge extending inwardly disposed to guide a side of packaged products stacked vertically in the housing, and at least one locking means for each side guide member to lock the side guide member at a chosen angle from the inside surface of the side wall. The dispenser also includes a rear guide device including at least one rear guide member capable of extending inwardly into the inner chamber from the inside surface of the rear wall, the member including an outer edge connected to the inside surface of the rear wall by a vertical living hinge, and an elongate vertical inner edge extending inwardly disposed to guide a rear side of packaged products stacked vertically in the housing, and at least one locking means for each rear side guide member to lock the rear guide member at a chosen angle from the inside surface of the rear wall. The dispenser also includes a front opening height control device that includes at least one front opening height control member capable of extending upwardly into the inner chamber from the inside floor surface of the bottom wall, each of the height control members includes an outer edge connected to the inside floor surface of the bottom wall by a horizontal living hinge, and an elongate horizontal inner edge extending upwardly disposed to adjust the height of the front opening and guide a bottom side of the bottom packaged product of the packaged products stacked vertically in the housing, and at least one locking means for each front opening height control member to lock the front opening height control member at a chosen angle from the floor surface of the bottom wall.

It is preferred that there be two side guide devices, one extending inwardly into the inner chamber from the inside surface of the left side wall and one extending inwardly into the inner chamber from the inside surface of the right side wall. It is also preferred that there be two front opening height control members capable of extending upwardly into the inner chamber from the inside floor surface of the bottom wall.

Another embodiment of the invention is a dispenser, preferably a point of purchase gravity feed packaged product dispenser, that includes a housing with an inner chamber of sufficient size and shape to hold a plurality of packaged products stacked vertically, the housing preferably being molded of a plastic polymer having the capability of forming living hinges along chosen opposing joined edges, preferably a polyolefin plastic polymer, the housing including a bottom wall with an inside floor surface, a rear wall with an inside surface, a right wall with an inside surface, a left wall with an inside surface, and a front wall with a lower edge. The housing has a front opening extending frontwardly from the inner chamber and having a height bounded by the lower edge of the front wall and the inside floor surface. The dispenser further includes a right side guide device that includes at least one right side guide member capable of extending inwardly into the inner chamber from the inside surface of the right wall. The guide member includes an outer edge connected to the inside surface of the right wall by vertical living hinge, and an elongate vertical inner edge extending inwardly disposed to guide a right side of packaged products stacked vertically in the housing. The guide device includes at least one locking means for each right side guide member to lock the right side guide member at a chosen angle from the inside surface of the right wall. The dispenser further includes a left side guide device that includes at least one left side guide member capable of extending inwardly into the inner chamber from the inside surface of the left wall. The member includes an outer edge connected to the inside surface of the left wall by vertical living hinge, and an elongate vertical inner edge extending inwardly disposed to guide a left side of packaged products stacked vertically in the housing The left side guide device includes at least one locking means for each left side guide member to lock the left side guide member at a chosen angle from the inside surface of the left wall. The dispenser further includes a rear guide device that includes at least one rear guide member capable of extending inwardly into the inner chamber from the inside surface of the rear wall. The member includes an outer edge connected to the inside surface of the rear wall by vertical living hinge, and an elongate vertical inner edge extending inwardly disposed to guide a rear side of packaged products stacked vertically in the housing. The rear guide device includes at least one locking means for each rear side guide member to lock the rear guide member at a chosen angle from the inside surface of the rear wall. The dispenser further includes a front opening height control device that includes at least two front opening height control members capable of extending upwardly into the inner chamber from the inside floor surface of the bottom wall. Each of the members includes an outer edge connected to the inside floor surface of the bottom wall by horizontal living hinge, and an elongate horizontal inner edge extending upwardly disposed to adjust the height of the front opening and guide a bottom side of the bottom packaged product of the packaged products stacked vertically in the housing. The height control device includes at least one locking means for each front opening height control member to lock the front opening height control member at a chosen angle from the floor surface of the bottom wall.

It is preferred that the housing be a parallelepiped of a pliable plastic polymer, more preferably a polyolefin polymer, in two parts, one part with opposing vertical side panels, a back panel and a bottom panel joined at their adjacent adjoining edges by living hinges, and a second part being a front panel adapted to interlock to the free vertical edges of the side panels forming opposing vertical grooves along each vertical edge of the front panel adapted to receive graphic panels slid into the opposing grooves to cover the front panel. It is also preferred that the housing be a parallelepiped of a polyolefin plastic in two or three parts with one part having living hinges along adjoining vertical edges of adjacent side panels and a back panel, wherein a front panel interlocks along adjoining vertical edges of the adjacent side panels, the bending of the living hinges and the interlocking forming along all of the adjoining vertical edges open ended at the top vertical grooves opening opposing across the face of the front panel adapted to receive graphic panels slid into the opposing grooves to cover the front panel. It is also preferred that the locking means for the right side guide member, the left side guide member, and the rear guide member each include cantilevered spring members having a first end integrally connected to the bottom wall and aligned with the inside floor surface, a length angled upwardly over an opening in the bottom wall and a second unsupported end extending above the inside floor surface adapted to engage a lower edge of the respective guide member and hold it against a stop member extending upwardly from the inside floor surface of the bottom wall. It is further preferred that there be at least two locking means for each right side guide member, left side guide member, and rear guide member, each locking means being positioned to hold and stop the respective guide member at a chosen angle from the respective inside wall. It is preferred that each of the locking means for the front opening height control members include at least one arcuate concave cut out along a portion of the outer edge with at least one notch cut out of an edge of the arcuate cut out, and a locking member that includes a first edge disposed perpendicular to the outer edge of the front opening height control member and connected adjacent to the arcuate concave cut out and to the inside floor surface of the bottom wall by horizontal living hinge, and a second free convex arcuate edge with at least one notch cut out of said edge, the second arcuate edge disposed to engage with the concave arcuate edge with the respective notches interfitting together to fix the front opening height control member at a chosen angle with the inside floor surface. It is more preferred that there be at least two notches on arcuate concave cut out edge of the front opening height control member, and at least two respective notches on second free convex arcuate edge on the locking member, the engagement of the respective pairs of notches enabling the locking of the front opening height control member at at least two angles from the inside floor surface.

DESCRIPTION OF PREFERRED EMBODIMENTS

A preferred embodiment of the present invention to provide a point of purchase gravity feed dispenser that is injection molded out of a polyolefin plastic in two or three parts with at least one part having living hinges along adjoining vertical edges of adjacent side panels and a back panel, wherein a front panel interlocks along adjoining vertical edges of the adjacent side panels, the bending of the living hinges and the interlocking forming along all of the adjoining vertical edges open ended at the top vertical grooves opening opposing across the face of each side panel and the front panel adapted to receive graphic panels slid into the opposing grooves to cover the respective panel.

Figure 1:
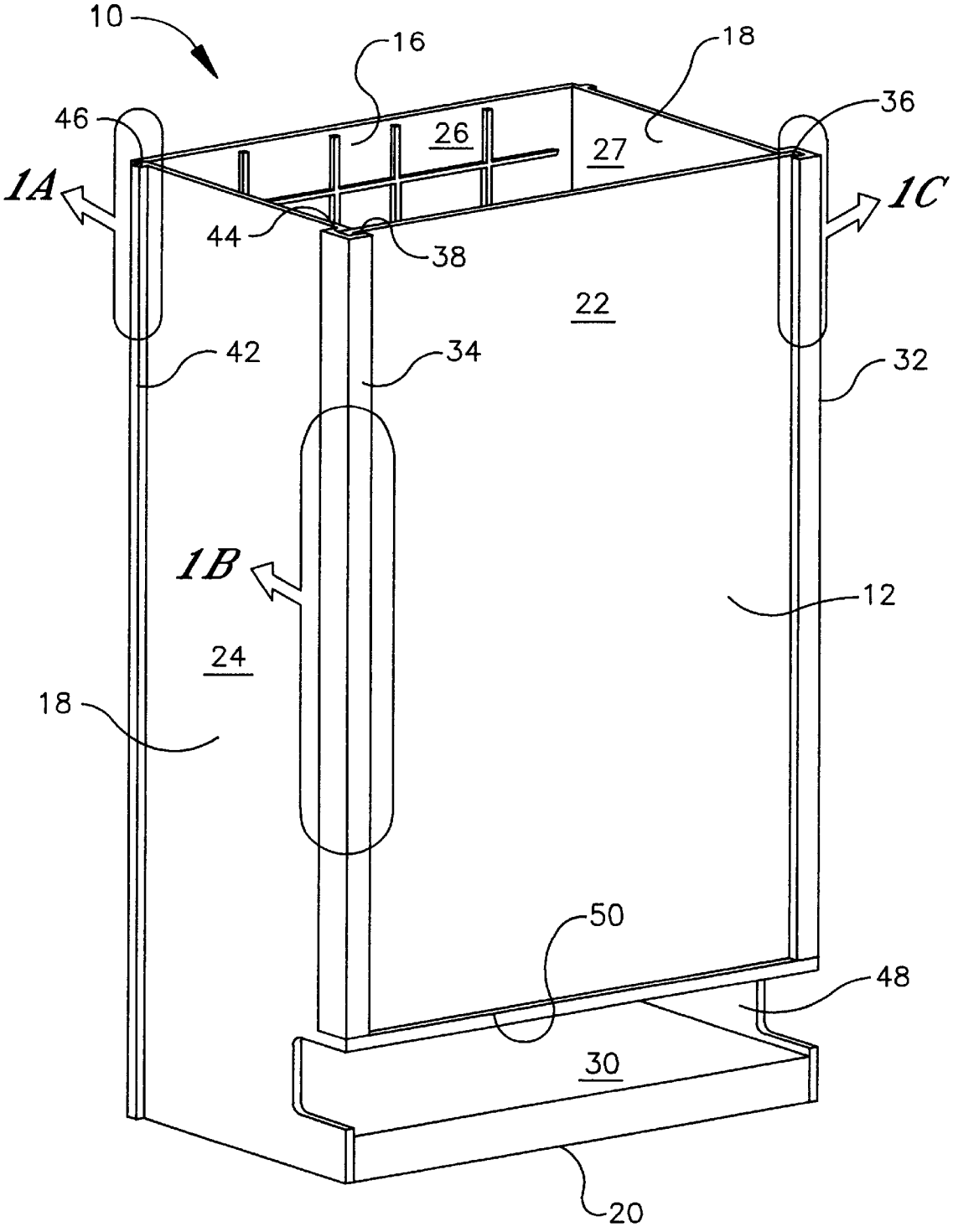
FIG. 1 is a top-front-right side perspective view of a dispenser of the invention.
Figure 1A:
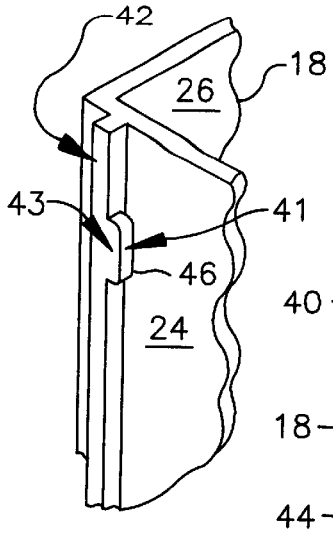
FIG. 1*a* is an enlarged cut-away perspective view of a portion of FIG. 1 showing the upper rear left corner of dispenser 10.
Figure 1B:
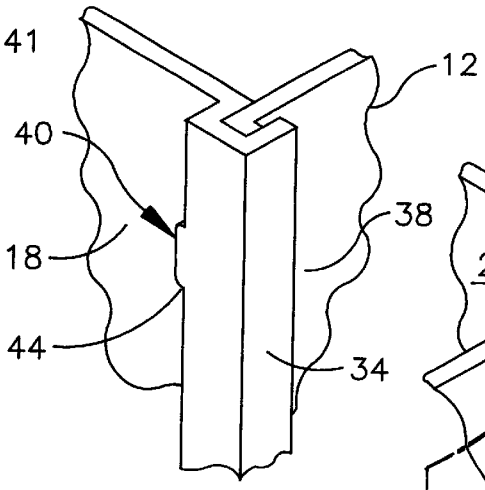
FIG. 1*b* is an enlarged cut-away perspective view of a portion of FIG. 1 showing a median section of the front left vertical edge of dispenser 10.
Figure 1C:
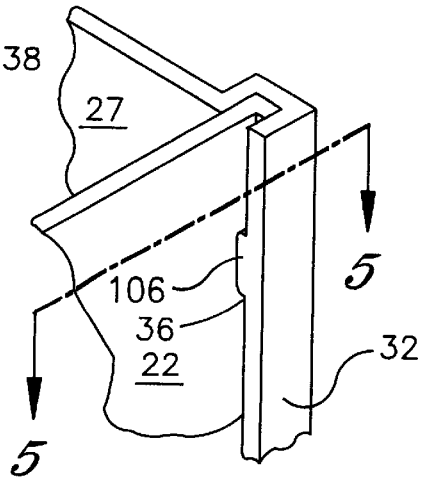
FIG. 1*c* is an enlarged cut-away perspective view of a portion of FIG. 1 showing the upper front right corner of dispenser 10.

Device 10, pictured in FIG. 1, is a gravity feed dispenser injection molded in two parts of polypropylene polymer, although other plastics are satisfactory, including other polyolefin polymeric plastics. The ability of the polymer to form a "living hinge" is important for the efficient manufacturing and use of the dispenser. A "living hinge" is formed by molding a thin continuous web along the hinge line and bending the hinge soon after molding. Device 10 is pictured in FIG. 1 ready to use and in the balance of the figures in the "as manufactured" state and opened up to view the interior mechanisms. Device 10 consists of front wall panel 12, right side wall panel 14, rear wall panel 16, left side wall panel 18, and bottom panel 20. Front face 22, left face 24, and a right face (hidden and a mirror image of face 24) are generally covered by graphic advertising sheets. As shown in FIGS. 1*b* and 1*c*, a front graphic advertising sheet (not pictured), sized to cover the entire face 22, is slid into cavities 36 and 38 formed by a plurality of vertical opposing tabs, 106 and 108 (hidden in this view), spaced apart along and extending inwardly from shoulders 32 and 34 extending the full length of the vertical front corners. Likewise, as shown in FIGS. 1*a* and 1*b*, a left side graphic advertising sheet is slid into cavities 44 and 46 under opposing tabs 40 and 43 spaced along the length of shoulder 34 and rib 42 extending vertically along the rear corner of the left side. Tab 43 extends over opening 41 through wall 18 as do the other tabs. For example, tab 40 is viewed through such an opening in FIG. 3. Also, for clarity, while tabs 43, 40, and 106 are present in plurality spaced apart along the respective vertical corners of device 10, they are only shown once in the enlarged FIGS. 1*a*, 1*b*, and 1*c*. Similarly, although hidden, a right side graphic advertising sheet is slid into tabs spaced along the length of the vertical right front corner and the rear corner of the right side. Inside face 26 of rear panel 16 and inside face 28 of left panel 18 are visible through the open top of dispenser 10. Inside face 27 of right panel 14 is hidden in this view. Front slot dispensing opening 48 is bounded by floor surface 30 of bottom panel 20, lower edge 50 of front panel 12, and inside faces 27 and 28 of their respective side panels. This size and shape represents the largest dimensions of products that can be dispensed, although, as will be described below, all of these dimensions can be reduced individually and in any combination.

Figure 2:
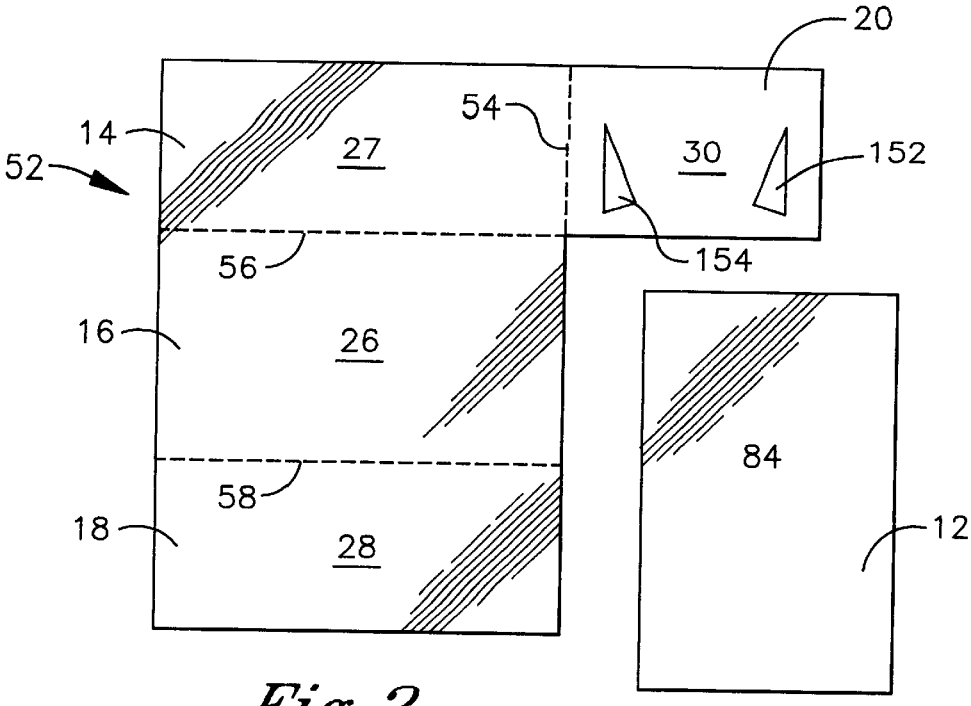
FIG. 2 is a diagram of the orientation of the major parts of the dispenser shown in FIG. 1 as molded.
Figure 3:
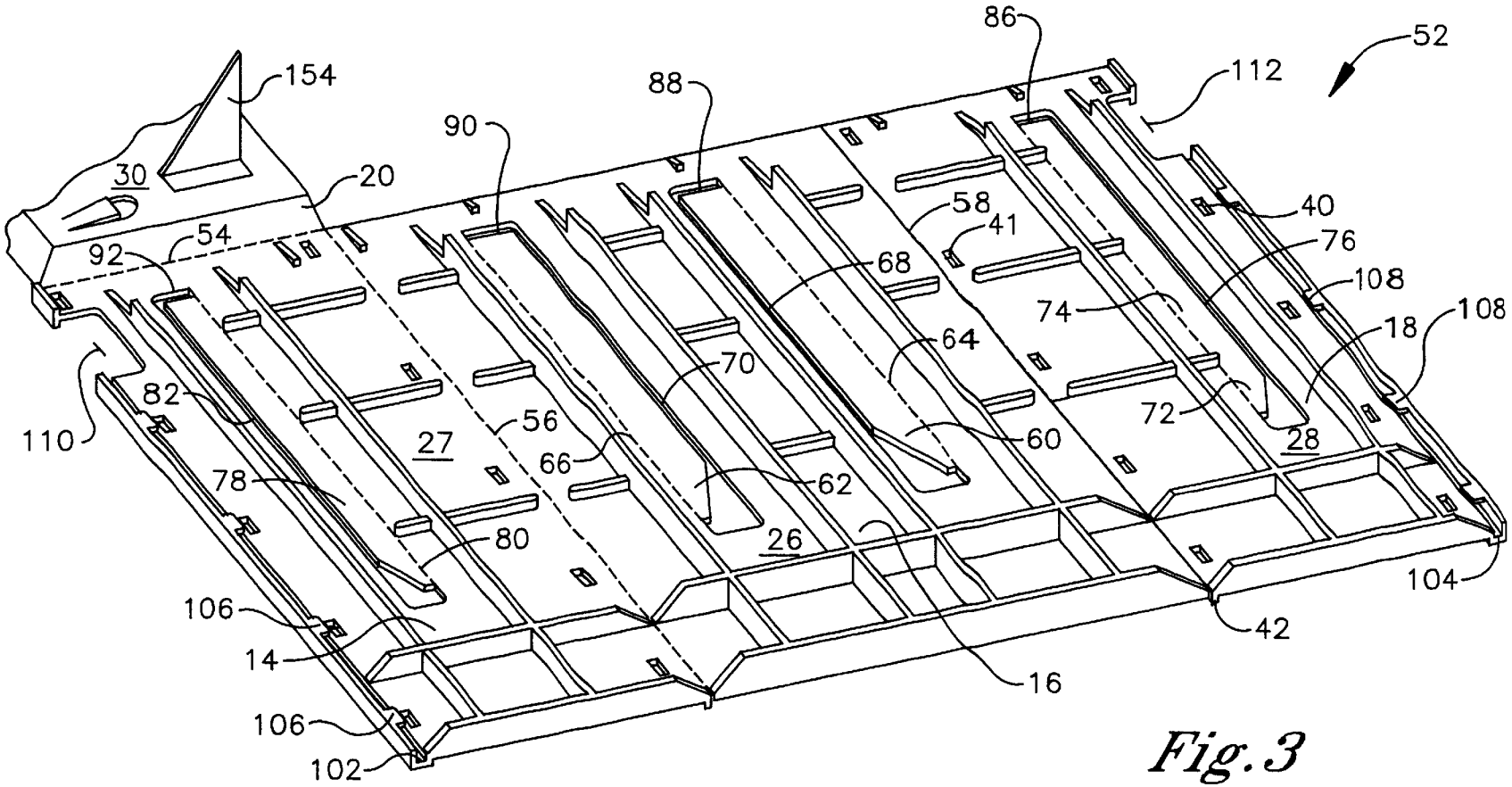
FIG. 3 is a perspective view of the inside surfaces of the back and side walls and cut off portion of the top inside surface of the floor section, all of the dispenser shown in FIG. 1, and all shown as molded in one flat piece before being folded to form a major portion of said dispenser.
Figure 5:
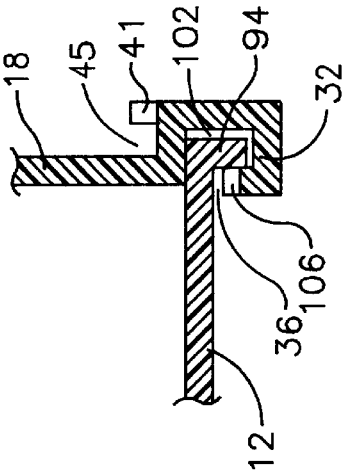
FIG. 5 is a horizontal cut-away cross-sectional view along lines 5—5 of FIG. 1 of vertically interlocked edges of the front wall and the right side wall as shown in FIG. 1*c*.
Figure 4:
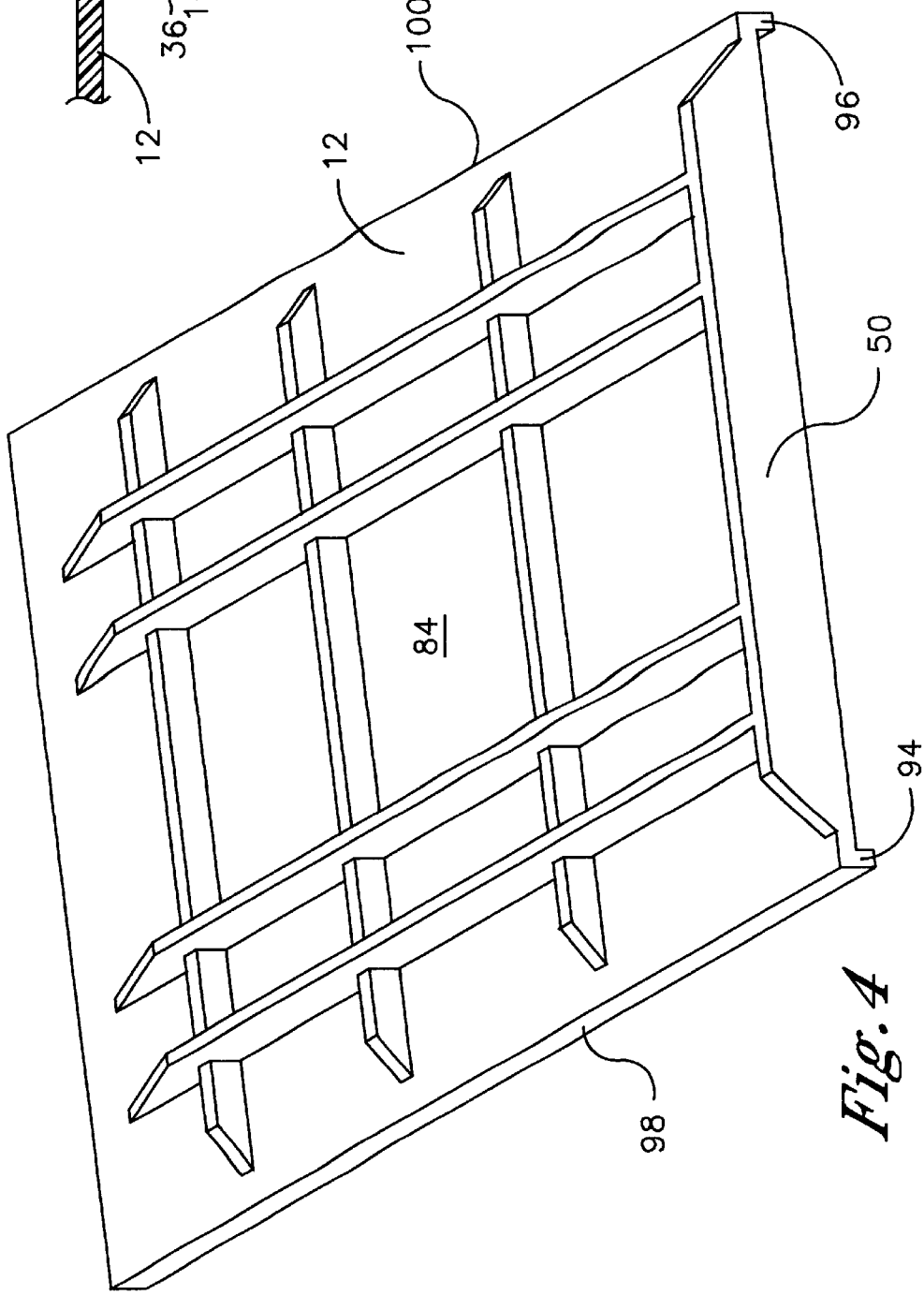
FIG. 4 is a perspective view of the inside surface facing to the rear of the front wall of the dispenser shown in FIG. 1.
Figure 6:
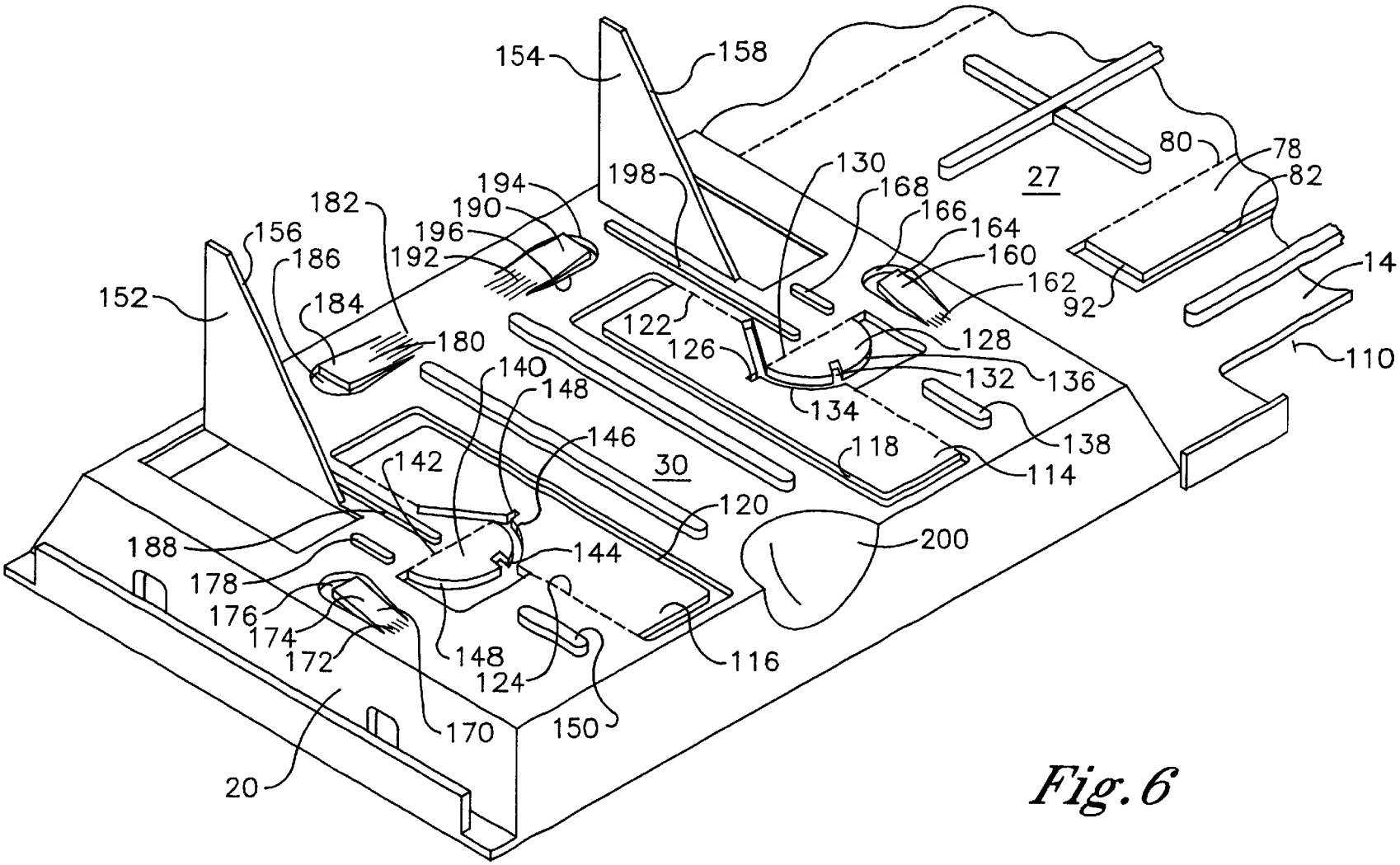
FIG. 6 is a top, front, left side perspective view of the top inside surface of the floor section connected to a cut off portion of the left side wall, all of the dispenser shown in FIG. 1.
Figure 8:
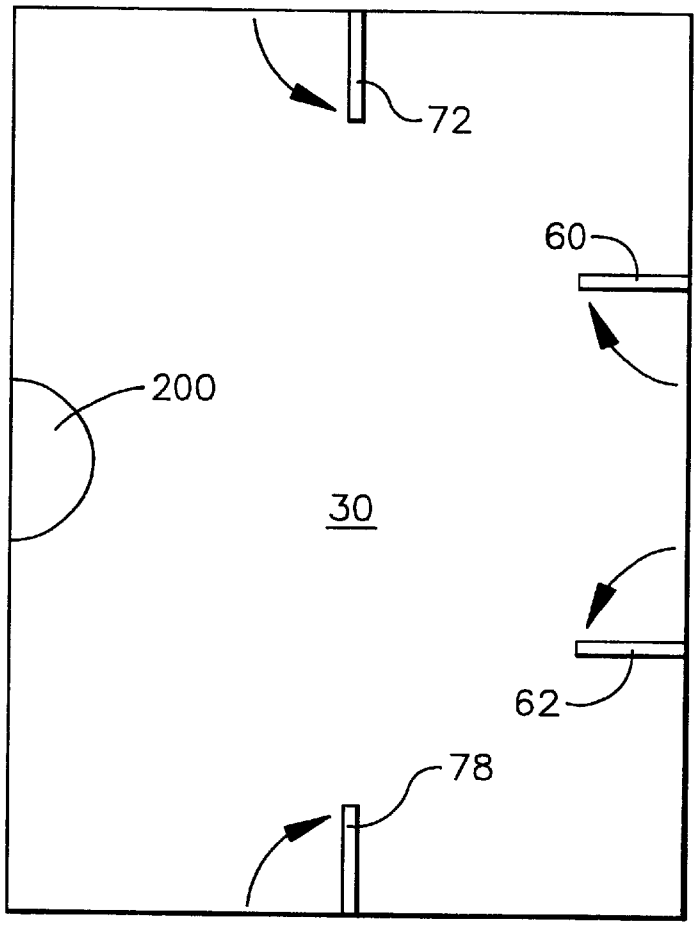
FIG. 8 is a diagram of the top surface of the floor section shown n FIG. 6 with the back and side walls interlocked together and to the floor section, showing the position of the side guide members and the rear guide members locked in their extended positions to guide and dispense video slip sleeve and capsule package.
Figure 7:
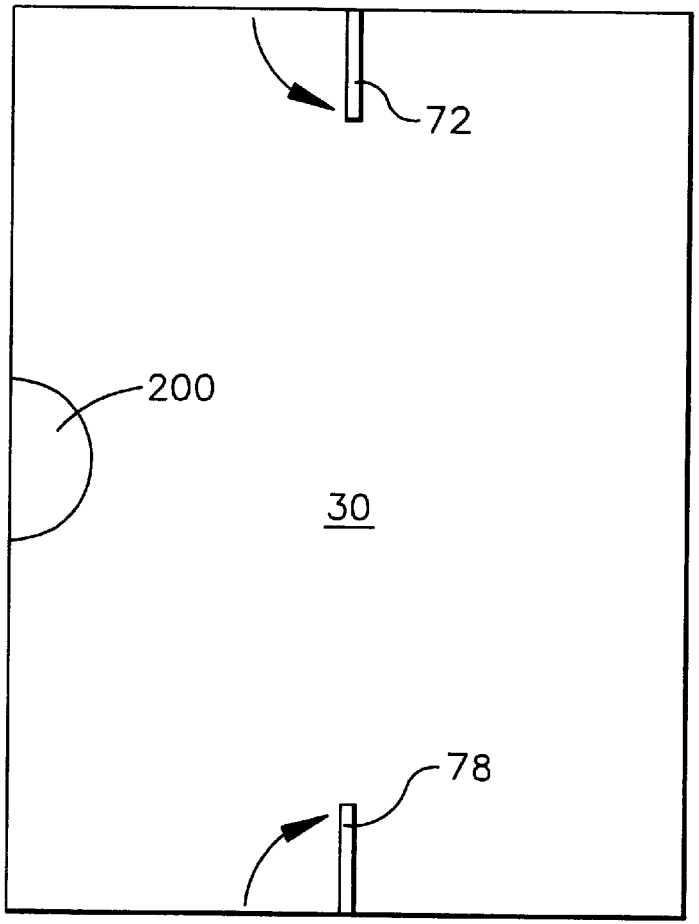
FIG. 7 is a diagram of the top surface of the floor section shown in FIG. 6 with the back and side walls interlocked together and to the floor section, showing the position of the side guide members locked in their extended positions to guide and dispense DVD packages.

FIG. 2 is a diagram showing the layout of the two injection molded polypropylene parts that make up dispenser device 10. The largest part 52 includes four panel connected along their adjacent edges by living hinges. The right edge of bottom 20 is connected through living hinge 54 to the lower edge of right side 14. Likewise the rear vertical edge of right side 14 is connected through living hinge 56 to the right vertical edge of back 16. Likewise the rear vertical edge of left side 18 is connected through living hinge 56 to the right vertical edge of back 16. Front panel 12 is a separate second molding. The mirror image of part 52 will also perform equally well. A major portion of part 52 is shown in FIG. 3, with left rear guide member 60 and right rear guide member 62 are attached through living hinges 64 and 66 to surface 26 of back panel 16, the guide members being free to pivot into the interior chamber formed by the panels on the hinges to a chosen angle with surface 26. When the guide members are fixed rear vertical guide edges 68 and 70 fix the distance between inside surface 84 of front panel 12 and the guide edges fixing the chosen width of packages stacked in the chamber. Similarly, left guide member 72 and right guide member 78 are attached through living hinges 74 and 80 to inside surface 28 and inside surface 27, respectively, the guide members being free to pivot into the interior chamber on the hinges to a chosen angle with surfaces 28 and 27, respectively. When the guide members are fixed at chosen angles, left vertical guide edge 76 and right vertical guide edge 82 fix the distance between the guide edges fixing the chosen length of packages stacked in the chamber. Lower edges 88 and 90 of the rear guide members and lower edges 86 and 92 of the left and right guide members, respectively, engage the stops and spring locks on floor surface 30 of bottom panel 20 to hold the guide members at a chosen angle. To form dispenser 10 right panel 14 is folded upwardly on hinge 54 against bottom panel 20, rear panel 16 is folded around bottom panel 20, and left panel is folded around the left side of bottom panel 20 to form a parallelepiped with an open top and front. As shown in FIG. 4 front panel 12 connects into formed first part 52 with frontwardly extending ribs, 94 and 96, disposed along vertical right edge 98 and left edge 100 of panel 12, respectively, engaging vertical grooves 102 and 104 opening inwardly along the front edges of right panel 14 and left panel 18, respectively. As shown in FIG. 3, retaining tabs 106 and 108 spaced apart along the length of the grooves extend horizontally over a portion of grooves 102 and 104 to interlock over ribs 94 and 96 to secure front panel 12 to part 52, and provide cavities under the tabs to hold graphic sheets on the front vertical edges of front panel 12. The height of front panel 12 is chosen to position lower edge 50 above floor surface 30 forming front opening 48 bounded by cut outs 110 and 112 from right panel 14 and left panel 18, respectively. opposing vertical cavities 36 and 38 to receive advertising sheets covering the front panel are formed at each vertical corner as shown in FIG. 5, the figure being a horizontally cut cross-sectional view through right front corner looking downwardly along lines 5—5, wherein rib 94 engages groove 102 formed by shoulder 32 forming right front cavity 36 and front right side cavity 45 under tabs 41. Cavities 36 receives the right side of a graphic sheet covering front panel 12 and cavities 45 receives the left side of a graphic sheet covering left panel 14. Similarly, the left front corner forms grooves to receive and hold the left side of the graphic sheet covering front panel 12 and the front edge of a graphic sheet covering left panel 18. As shown in FIG. 6 bottom panel 20 is shown with floor surface 30 disposed with the front facing the viewer. Right height control member 114 and left height control member 116 are each cut out of panel 20 each attached through living hinges 122 and 124 respectively. As the height control members are pivoted upwardly to a chosen angle on their respective hinges horizontal right height control edge 118 and left right height control edge 120 are positioned and locked into place to support a stack of packages in the dispenser and to set a narrower opening 48 from which the packages are dispensed. Right height control member 114 is locked into place by pivoting upwardly locking member 128 on hinge 130 to engage notch 132 on an outer convex arcuate edge 136 into notch 126 on concave arcuate edge 134 cut our of the lower edge of member 114. Locking member 128 pivots upwardly perpendicular to and under member 114 to engage notches 132 and 126. Likewise left height control member 116 is locked into place by pivoting upwardly locking member 140 on hinge 142 to engage notch 144 on an outer convex arcuate edge 148 into notch 148 on concave arcuate edge 146 cut out of the lower edge of member 116. Locking member 140 pivots upwardly perpendicular to and under member 116 to engage notches 144 and 148. It is clear that multiple notches and even multiple locking members may be employed to fix the height control members at multiple adjustable angles from floor 30 to adjust the distance that the control edge is above the floor thereby to adjust the height of opening 48. Stops 138 and 150 provide added structural integrity as control members 114 and 116 are pivoted to right angles to surface 30 against the stops. Parallel guide members 152 and 154 are rigidly connected to bottom panel 20 as part of molding 152, together providing rearwardly sloped edges 156 and 158, respectively, the edges facing frontwardly to kick the bottom package of the stacked packages frontwardly onto edges 118 and 120 and out opening 48. Cantilevered spring lock member 160 is attached at end 162, being integrally molded into bottom panel 20, and extending lengthwise over opening 166 through said panel with free end 164 above surface 30 so that when right guide member 78 is pivoted inwardly on hinge 80, lower edge 92 is moving proximate surface 30 and rides over lock member 160 depressing end 164 downwardly until edge 92 moves past the free end against stop 168 allowing member 160 to spring upwardly behind member 78 locking it in place at right angles to surface 27. Likewise, cantilevered spring lock member 170 is attached at end 172, being integrally molded into bottom panel 20, and extending lengthwise over opening 176 through said panel with free end 174 above surface 30 so that when left guide member 72 is pivoted inwardly on hinge 74, lower edge 86 is moving proximate surface 30 and rides over lock member 170 depressing end 174 downwardly until edge 86 moves past the free end against stop 178 allowing member 170 to spring upwardly behind member 72 locking it in place at right angles to surface 28. Likewise, cantilevered spring lock members 180 and 190 are attached at ends 182 and 192, being integrally molded into bottom panel 20, and extending lengthwise over openings 186 and 196 through said panel with free ends 184 and 194 above surface 30 so that when left rear guide member 60 and right rear guide member 62 are pivoted inwardly on hinges 64 and 66, lower edges 88 and 90 are moving proximate surface 30 and ride over lock members 180 and 190 depressing ends 184 and 194 downwardly until edges 88 and 90 move past the free ends against stops 188 and 198 allowing members 180 and 190 to spring upwardly behind members 60 and 62 locking them in place at right angles to surface 26. Cup shaped depression 200 is molded into the center of the front upper corner of bottom panel 20 to aid a person sticking a finger or two under the lowermost package to lift it and remove it from dispenser 10. The diagram of FIG. 7 is illustrative of an adjustment that can be made to the dispenser which, with no guides extended inwardly, handles and dispenses VHS tapes in the "clam shell" type package. In FIG. 7, with height control members 114 and 116 pivoted upwardly and locked in place, left guide member 72 and right guide member 78 are pivoted inwardly and locked in place to handle DVD disk packages. Similarly in FIG. 8, with height control members 114 and 116 pivoted upwardly and locked in place, left guide member 72, right guide member 78, and rear guide members 60 and 62 are all pivoted inwardly and locked in place to handle VHS slip sleeve and capsule packages.

Figure 9:
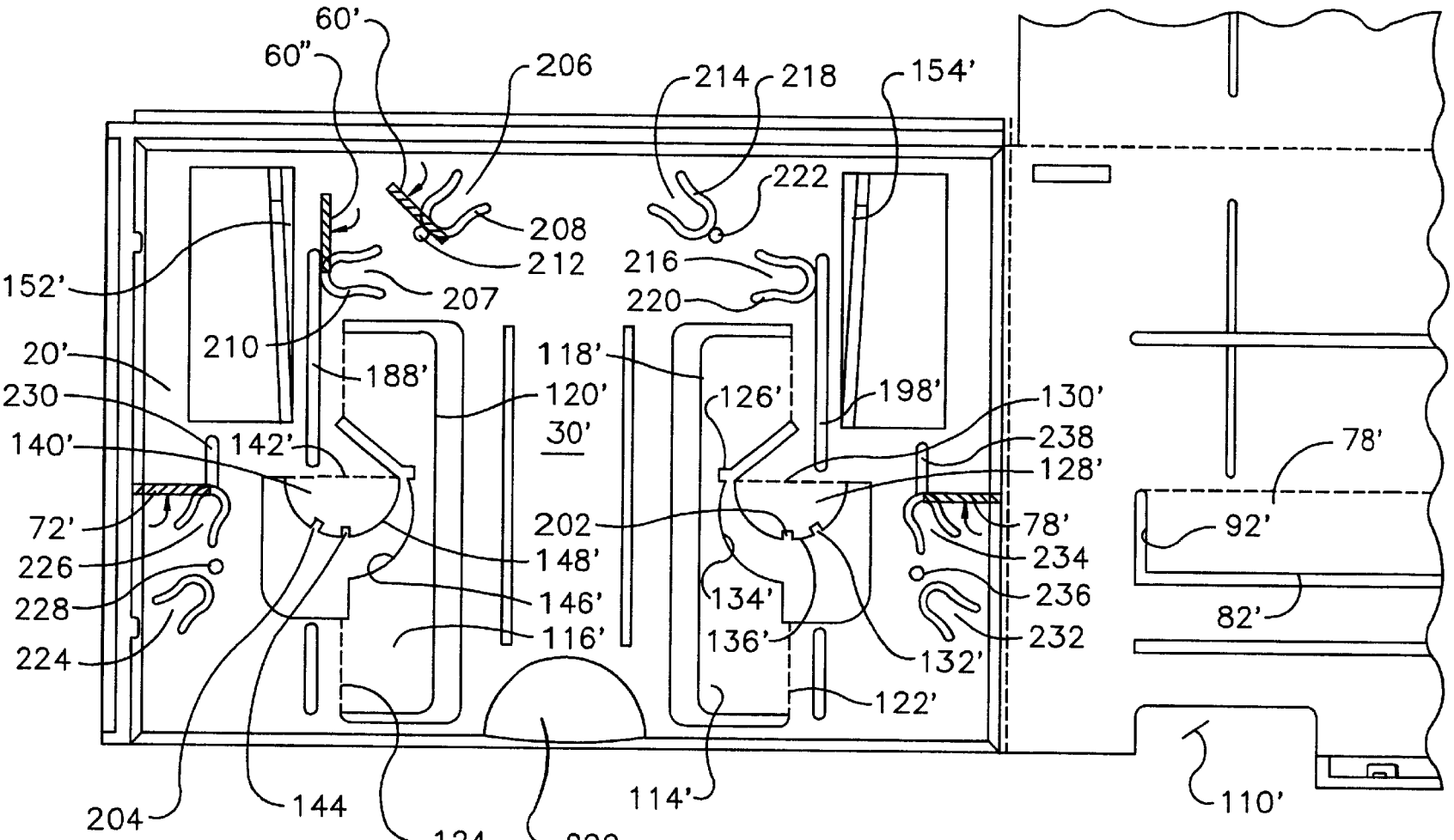
FIG. 9 is a top plan view of the top inside surface of a floor section connected to a cut off portion of the left side wall, all of a second embodiment of a dispenser of the invention.

A bottom panel 20' of a second embodiment is illustrated in FIG. 9, wherein second notches 202 and 204 are cut into convex edges 136' and 148' of locking members 128' and 140', respectively. The prime (') designation is affixed to numbered parts to indicate that the "primed" part is essentially identical to part of the same number of a prior embodiment. For the sake of brevity, the description of the part will not be repeated. This modification allows height guide members 114' and 116' to be locked at an angle less than 90 degrees from surface 30' and thus accommodate a larger package than when the guide members are locked fully upwardly. Further, locking members 206 and 207 are extending above floor surface 30' above openings 208 and 210 and operate in a similar fashion to their larger counterparts, locking members 180 and 190. The free ends of members 206 and 207 spring up after a rear guide member swings past and locks the guide against detent stop 212 in position 60' and against stop 188' in position 60". The "arrows" show the pivoting movement of the guide members throughout this figure and positions of the guide members are shown in shadow view. Thus, each guide member can be locked in a chosen angle as a plurality of locking members and stops may be incorporated in the bottom panel. Similarly, the free ends of locking members 214 and 216 are extending above floor surface 30' above openings 218 and 220. The free ends of members 214 and 216 spring up after a right rear guide member swings past and locks the guide against detent stop 222 in an acute angle to rear surface 26' and against stop 198' in a position at a right angle to surface 26'. Likewise, the free ends of locking members 224 and 226 spring up after a left guide member 72' swings past and locks against detent stop 228 or against stop 230 in either chosen angle position. Likewise, the free ends of locking members 232 and 234 spring up after a right guide member 78' swings past and locks against detent stop 234 or against stop 238 in a chosen angle position.

While this invention has been described with reference to specific embodiments disclosed herein, it is not confined to the details set forth and the patent is intended to include modifications and changes which may come within and extend from the following claims.

I claim:

1. A gravity feed packaged product dispenser comprising:

(A) a housing with an inner chamber of sufficient size and shape to hold a plurality of packaged products stacked vertically, the housing comprising:
  (i) a bottom wall with an inside floor surface,
  (ii) a rear wall with an inside surface,
  (iii) a right wall with an inside surface,
  (iv) a left wall with an inside surface, and
  (v) a front wall with a lower edge, (B) the housing having a front opening extending frontwardly from the inner chamber having a height bounded by the lower edge of the front wall and the inside floor surface, (C) a right side guide device comprising:
  (a) at least one right side guide member capable of extending inwardly into the inner chamber from the inside surface of the right wall, the member comprising:
    (i) an outer edge connected to the inside surface of the right wall by a vertical living hinge, and
    (ii) an elongate vertical inner edge extending inwardly disposed to guide a right side of packaged products stacked vertically in the housing, and
  (b) at least one locking means for each right side guide member to lock the right side guide member at a chosen angle from the inside surface of the right wall, (D) a left side guide device comprising:
  (a) at least one left side guide member capable of extending inwardly into the inner chamber from the inside surface of the left wall, the member comprising:
    (i) an outer edge connected to the inside surface of the left wall by a vertical living hinge, and
    (ii) an elongate vertical inner edge extending inwardly disposed to guide a left side of packaged products stacked vertically in the housing, and
  (b) at least one locking means for each left side guide member to lock the left side guide member at a chosen angle from the inside surface of the left wall, (E) a rear guide device comprising:
  (a) at least one rear guide member capable of extending inwardly into the inner chamber from the inside surface of the rear wall, the member comprising:
    (i) an outer edge connected to the inside surface of the rear wall by a vertical living hinge, and
    (ii) an elongate vertical inner edge extending inwardly disposed to guide a rear side of packaged products stacked vertically in the housing, and
  (b) at least one locking means for each rear side guide member to lock the rear guide member at a chosen angle from the inside surface of the rear wall, and (F) a front opening height control device comprising:
  (a) at least two front opening height control members capable of extending upwardly into the inner chamber from the inside floor surface of the bottom wall, each of the members comprising:
    (i) an outer edge connected to the inside floor surface of the bottom wall by a horizontal living hinge, and
    (ii) an elongate horizontal inner edge extending upwardly disposed to adjust the height of the front opening and guide a bottom side of the bottom packaged product of the packaged products stacked vertically in the housing, and
  (b) at least one locking means for each front opening height control member to lock the front opening height control member at a chosen angle from the floor surface of the bottom wall.

2. The dispenser of claim 1 wherein the housing is a parallelepiped of a polyolefin plastic in two parts, one part with opposing vertical side panels, a back panel and a bottom panel joined at their adjacent adjoining edges by living hinges, and a second part being a front panel adapted to interlock to the free vertical edges of the side panels forming opposing vertical grooves along each vertical edge adapted to receive graphic panels slid into the opposing grooves to cover the front and side panels.

3. The dispenser of claim 1 wherein the housing is a parallelepiped of a polyolefin plastic in two or three parts with at least one part having living hinges along adjoining vertical edges of adjacent side panels and a back panel, wherein a front panel interlocks along adjoining vertical edges of the adjacent side panels, the bending of the living hinges and the interlocking forming along all of the adjoining vertical edges open ended at the top vertical grooves opening opposing across the face of each side panel and the front panel adapted to receive graphic panels slid into the opposing grooves to cover the respective panel.

4. The dispenser of claim 1 wherein the locking means for the right side guide member, the left side guide member, and the rear guide member each comprise cantilevered spring members having a first end integrally connected to the bottom wall and aligned with the inside floor surface, a length angled upwardly over an opening in the bottom wall and a second unsupported end extending above the inside floor surface adapted to engage a lower edge of the respective guide member and hold it against a stop member extending upwardly from the inside floor surface of the bottom wall.

5. The dispenser of claim 4 wherein there are at least two locking means for each right side guide member, left side guide member, and rear guide member, each locking means being positioned to hold and stop the respective guide member at a chosen angle from the respective inside wall.

6. The dispenser of claim 1 wherein each of the locking means for the front opening height control members comprise:

(a) at least one arcuate concave cut out along a portion of the outer edge of said control member with at least one notch cut out of an edge of the arcuate cut out, (b) a locking member comprising:

(i) an first edge disposed perpendicular to the outer edge of the front opening height control member and connected adjacent to the arcuate concave cut out and to the inside floor surface of the bottom wall by horizontal living hinge, and (ii) a second free convex arcuate edge with at least one notch cut out of said edge, the second arcuate edge disposed to engage with the concave arcuate edge with the respective notches interfitting together to fix the front opening height control member at a chosen angle with the inside floor surface.

7. The dispenser of claim 6 wherein there are at least two notches on arcuate concave cut out edge of the front opening height control member, and at least two respective notches on second free convex arcuate edge on the locking member, the engagement of the respective pairs of notches enabling the locking of the front opening height control member at at least two angles from the inside floor surface.

8. A gravity feed packaged product dispenser comprising:

(A) a housing with an inner chamber of sufficient size and shape to hold a plurality of packaged products stacked vertically, the housing comprising:

(i) a bottom wall with an inside floor surface, (ii) a rear wall with an inside surface, (iii) a right side wall with an inside surface, (iv) a left side wall with an inside surface, and (v) a front wall with a lower edge, (B) the housing having a front opening extending frontwardly from the inner chamber having a height bounded by the lower edge of the front wall and the inside floor surface, (C) at least one side guide device comprising:

(a) at least one side guide member capable of extending inwardly into the inner chamber from the inside surface of a side wall, the member comprising:

(i) an outer edge connected to the inside surface of the side wall by a vertical living hinge, and (ii) an elongate vertical inner edge extending inwardly disposed to guide a side of packaged products stacked vertically in the housing, and (b) at least one locking means for each side guide member to lock the side guide member at a chosen angle from the inside surface of the side wall, (D) a rear guide device comprising:

(a) at least one rear guide member capable of extending inwardly into the inner chamber from the inside surface of the rear wall, the member comprising:

(i) an outer edge connected to the inside surface of the rear wall by a vertical living hinge, and (ii) an elongate vertical inner edge extending inwardly disposed to guide a rear side of packaged products stacked vertically in the housing, and (b) at least one locking means for each rear side guide member to lock the rear guide member at a chosen angle from the inside surface of the rear wall, and (E) a front opening height control device comprising:

(a) at least one front opening height control member capable of extending upwardly into the inner chamber from the inside floor surface of the bottom wall, each of the height control members comprising:

(i) an outer edge connected to the inside floor surface of the bottom wall by a horizontal living hinge, and (ii) an elongate horizontal inner edge extending upwardly disposed to adjust the height of the front opening and guide a bottom side of the bottom packaged product of the packaged products stacked vertically in the housing, and (b) at least one locking means for each front opening height control member to lock the front opening height control member at a chosen angle from the floor surface of the bottom wall.

9. The dispenser of claim 8 wherein there are two side guide devices, one extending inwardly into the inner chamber from the inside surface of the left side wall and one extending inwardly into the inner chamber from the inside surface of the right side wall.

10. The dispenser of claim 8 wherein there are two front opening height control members capable of extending upwardly into the inner chamber from the inside floor surface of the bottom wall.

11. The dispenser of claim 8 wherein the housing is a parallelepiped of a pliable plastic in two parts, one part with opposing vertical side panels, a back panel and a bottom panel joined at their adjacent adjoining edges by living hinges, and a second part being a front panel adapted to interlock to the free vertical edges of the side panels forming opposing vertical grooves along each vertical edge adapted to receive graphic panels slid into the opposing grooves to cover the front panel.

12. The dispenser of claim 8 wherein the housing is a parallelepiped of a polyolefin plastic in two or three parts with one part having living hinges along adjoining vertical edges of adjacent side panels and a back panel, wherein a front panel interlocks along adjoining vertical edges of the adjacent side panels, the bending of the living hinges and the interlocking forming along all of the adjoining vertical edges open ended at the top vertical grooves opening opposing across the face of the front panel adapted to receive graphic panels slid into the opposing grooves to cover the front panel.

13. The dispenser of claim 8 wherein the locking means for the side guide member and the rear guide member each comprise cantilevered spring members having a first end integrally connected to the bottom wall and aligned with the inside floor surface, a length angled upwardly over an opening in the bottom wall and a second unsupported end extending above the inside floor surface adapted to engage a lower edge of the respective guide member and hold it against a stop member extending upwardly from the inside floor surface of the bottom wall.

14. The dispenser of claim 13 wherein there are at least two locking means for each side guide member and each rear guide member, each locking means being positioned to hold and stop the respective guide member at a chosen angle from the respective inside wall surface.

15. The dispenser of claim 8 wherein each of the locking means for the front opening height control members comprise:

(a) at least one arcuate concave cut out along a portion of the outer edge of said control member with at least one notch cut out of an edge of the arcuate cut out, (b) a locking member comprising:

(i) an first edge disposed perpendicular to the outer edge of the front opening height control member and connected adjacent to the arcuate concave cut out and to the inside floor surface of the bottom wall by horizontal living hinge, and (ii) a second free convex arcuate edge with at least one notch cut out of said edge, the second arcuate edge disposed to engage with the concave arcuate edge with the respective notches interfitting together to fix the front opening height control member at a chosen angle with the inside floor surface.

16. The dispenser of claim 15 wherein there are at least two notches on arcuate concave cut out edge of the front opening height control member, and at least two respective notches on second free convex arcuate edge on the locking member, the engagement of the respective pairs of notches enabling the locking of the front opening height control member at at least two angles from the inside floor surface.

* * * * *